US008781835B2

(12) United States Patent
Nurminen et al.

(10) Patent No.: US 8,781,835 B2
(45) Date of Patent: Jul. 15, 2014

(54) METHODS AND APPARATUSES FOR FACILITATING SPEECH SYNTHESIS

(75) Inventors: Jani Kristian Nurminen, Lempaala (FI); Hanna Margareeta Silen, Tampere (FI); Elina Helander, Tampere (FI)

(73) Assignee: Nokia Corporation, Espoo (FI)

( * ) Notice: Subject to any disclaimer, the term of this patent is extended or adjusted under 35 U.S.C. 154(b) by 603 days.

(21) Appl. No.: 13/099,158

(22) Filed: May 2, 2011

(65) Prior Publication Data

US 2012/0109654 A1 May 3, 2012

Related U.S. Application Data

(60) Provisional application No. 61/329,941, filed on Apr. 30, 2010.

(51) Int. Cl.
*G10L 13/06* (2013.01)

(52) U.S. Cl.
USPC ..... 704/266

(58) Field of Classification Search
USPC ..... 704/258–269
See application file for complete search history.

(56) References Cited

U.S. PATENT DOCUMENTS

| | | | | |
|---|---|---|---|---|
| 2007/0203702 | A1 * | 8/2007 | Hirose et al. | 704/256 |
| 2008/0059190 | A1 * | 3/2008 | Chu et al. | 704/258 |
| 2009/0048841 | A1 | 2/2009 | Pollet et al. | |
| 2009/0083036 | A1 | 3/2009 | Zhao et al. | |

OTHER PUBLICATIONS

Ling et al., "The USTC and iFlytek Speech Synthesis System for Blizzard Challenge 2007", Proceedings of the Blizzard Challenge, Aug. 25, 2007, pp. 1-6.
Ling et al., The USTC System for Blizzard Challenge 2008, Proceedings of the Blizzard Challenge, 2008, 6 pages.
Lin et al., "Iterative Unit Selection With Unnatural Prosody Detection", International Symposium on Computer Architecture, Interspeech, Aug. 27-31, 2007, pp. 2909-2912.
Siu et al., "A Robust Viterbi Algorithm Against Impulsive Noise With Application to Speech Recognition", IEEE Transactions on Audio, Speech, and Language Processing, IEEE Transactions on Audio, Speech, and Language Processing, vol. 14, No. 6, Nov. 2006, pp. 2122-2133.
Pollet et al., "Synthesis by Generation and Concatenation of Multiform Segments", International Symposium on Computer Architecture, Interspeech, Sep. 22-26, 2008, pp. 1825-1828.
Aylett et al., "The CereProc Blizzard Entry 2009: Some Dumb Algorithms That Don't Work", Blizzard Challenge Workshop, 2009, 4 pages.
Silen et al., "Evaluation of Finnish Unit Selection and HMM-Based Speech Synthesis", International Symposium on Computer Architecture, Interspeech, Sep. 22-26, 2008, pp. 1853-1856.

* cited by examiner

*Primary Examiner* — Abul Azad
(74) *Attorney, Agent, or Firm* — Alston & Bird LLP

(57) ABSTRACT

Methods and apparatuses are provided for facilitating speech synthesis. A method may include generating a plurality of input models representing an input by using a statistical model synthesizer to statistically model the input. The method may further include determining a speech unit sequence representing at least a portion of the input by using the input models to influence selection of one or more pre-recorded speech units having parameter representations. The method may additionally include identifying one or more bad units in the unit sequence. The method may also include replacing the identified one or more bad units with one or more parameters generated by the statistical model synthesizer. Corresponding apparatuses are also provided.

15 Claims, 4 Drawing Sheets

METHODS AND APPARATUSES FOR FACILITATING SPEECH SYNTHESIS

CROSS-REFERENCE TO RELATED APPLICATIONS

The present application claims priority to U.S. Provisional Patent Application No. 61/329,941, filed on Apr. 30, 2010, the contents of which are incorporated herein by reference.

TECHNOLOGICAL FIELD

Embodiments of the present invention relate generally to speech processing technology and, more particularly, relate to methods and apparatuses for facilitating speech synthesis.

BACKGROUND

The modern communications era has brought about a tremendous expansion of wireline and wireless networks. Computer networks, television networks, and telephony networks are experiencing an unprecedented technological expansion, fueled by consumer demand. Wireless and mobile networking technologies have addressed related consumer demands, while providing more flexibility and immediacy of information transfer.

Current and future networking technologies continue to facilitate ease of information transfer and convenience to users. One area in which there is a demand to increase ease of information transfer relates to the delivery of services to a user of a mobile terminal. The services may be in the form of a particular media or communication application desired by the user, such as a music player, a game player, an electronic book, short messages, email, etc. The services may also be in the form of interactive applications in which the user may respond to a network device in order to perform a task or achieve a goal. The services may be provided from a network server or other network device, or even from the mobile terminal such as, for example, a mobile telephone, a mobile television, a mobile gaming system, etc.

In many applications, it is necessary for the user to receive audio information such as oral feedback or instructions from the network or mobile terminal. An example of such an application may be paying a bill, ordering a program, receiving driving instructions, etc. Furthermore, in some services, such as audio books, for example, the application is based almost entirely on receiving audio information. It is becoming more common for such audio information to be provided by computer generated voices. Accordingly, the user's experience in using such applications will largely depend on the quality and naturalness of the computer generated voice. As a result, much research and development has gone into speech processing techniques in an effort to improve the quality and naturalness of computer generated voices. Speech processing may generally include applications such as text-to-speech (TTS) conversion, speech coding, voice conversion, language identification, and numerous other like applications. In many speech processing applications, a computer generated voice, or synthetic speech, may be provided.

BRIEF SUMMARY

Methods, apparatuses, and computer program products are herein provided for facilitating speech synthesis. Systems, methods, apparatuses, and computer program products in accordance with various embodiments may provide several advantages to computing devices and computing device users. Some example embodiments synthesize speech using a combination of statistical model-based speech synthesis and unit selection-based speech synthesis. In this regard, some example embodiments use models generated using a statistical model to influence unit selection for determining a unit sequence. Some example embodiments determine bad units in the generated unit sequence. The detected bad units are replaced in some example embodiments with parameters generated by a statistical model synthesizer, such as a Hidden Markov Model synthesizer. In some example embodiments, the speech units used for unit selection have a parameter representation. In this regard, some example embodiments provide for speech synthesis through a combination of parameters specified by unit selection synthesis and parameters specified using statistical model-based synthesis.

In a first example embodiment, a method is provided, which comprises generating a plurality of input models representing an input by using a statistical model synthesizer to statistically model the input. The method of this embodiment further comprises determining a speech unit sequence representing at least a portion of the input by using the input models to influence selection of one or more pre-recorded speech units having parameter representations. The method of this embodiment may additionally comprise identifying one or more bad units in the unit sequence. The method of this embodiment may also comprise replacing the identified one or more bad units with one or more parameters generated by the statistical model synthesizer.

In another example embodiment, an apparatus is provided. The apparatus of this embodiment comprises at least one processor and at least one memory storing computer program code, wherein the at least one memory and stored computer program code are configured, with the at least one processor, to cause the apparatus to at least generate a plurality of input models representing an input by using a statistical model synthesizer to statistically model the input. The at least one memory and stored computer program code are configured, with the at least one processor, to further cause the apparatus of this embodiment to determine a speech unit sequence representing at least a portion of the input by using the input models to influence selection of one or more pre-recorded speech units having parameter representations. The at least one memory and stored computer program code may be configured, with the at least one processor, to additionally cause the apparatus of this embodiment to identify one or more bad units in the unit sequence. The at least one memory and stored computer program code may be configured, with the at least one processor, to also cause the apparatus of this embodiment to replace the identified one or more bad units with one or more parameters generated by the statistical model synthesizer.

In another example embodiment, a computer program product is provided. The computer program product of this embodiment includes at least one computer-readable storage medium having computer-readable program instructions stored therein. The program instructions of this embodiment comprise program instructions configured to generate a plurality of input models representing an input by using a statistical model synthesizer to statistically model the input. The program instructions of this embodiment further comprise program instructions configured to determine a speech unit sequence representing at least a portion of the input by using the input models to influence selection of one or more pre-recorded speech units having parameter representations. The program instructions of this embodiment may additionally comprise program instructions configured to identify one or more bad units in the unit sequence. The program instructions of this embodiment may also comprise program instructions configured to replace the identified one or more bad units with one or more parameters generated by the statistical model synthesizer.

In another example embodiment, a computer-readable storage medium carrying computer-readable program instructions is provided. The program instructions of this embodiment comprise program instructions configured to generate a plurality of input models representing an input by using a statistical model synthesizer to statistically model the input. The program instructions of this embodiment further comprise program instructions configured to determine a speech unit sequence representing at least a portion of the input by using the input models to influence selection of one or more pre-recorded speech units having parameter representations. The program instructions of this embodiment may additionally comprise program instructions configured to identify one or more bad units in the unit sequence. The program instructions of this embodiment may also comprise program instructions configured to replace the identified one or more bad units with one or more parameters generated by the statistical model synthesizer.

In another example embodiment, an apparatus is provided that comprises means for generating a plurality of input models representing an input by using a statistical model synthesizer to statistically model the input. The apparatus of this embodiment further comprises means for determining a speech unit sequence representing at least a portion of the input by using the input models to influence selection of one or more pre-recorded speech units having parameter representations. The apparatus of this embodiment may additionally comprise means for identifying one or more bad units in the unit sequence. The apparatus of this embodiment may also comprise means for replacing the identified one or more bad units with one or more parameters generated by the statistical model synthesizer.

The above summary is provided merely for purposes of summarizing some example embodiments of the invention so as to provide a basic understanding of some aspects of the invention. Accordingly, it will be appreciated that the above described example embodiments are merely examples and should not be construed to narrow the scope or spirit of the invention in any way. It will be appreciated that the scope of the invention encompasses many potential embodiments, some of which will be further described below, in addition to those here summarized.

BRIEF DESCRIPTION OF THE DRAWING(S)

Having thus described embodiments of the invention in general terms, reference will now be made to the accompanying drawings, which are not necessarily drawn to scale, and wherein:

DETAILED DESCRIPTION

Figure 1:
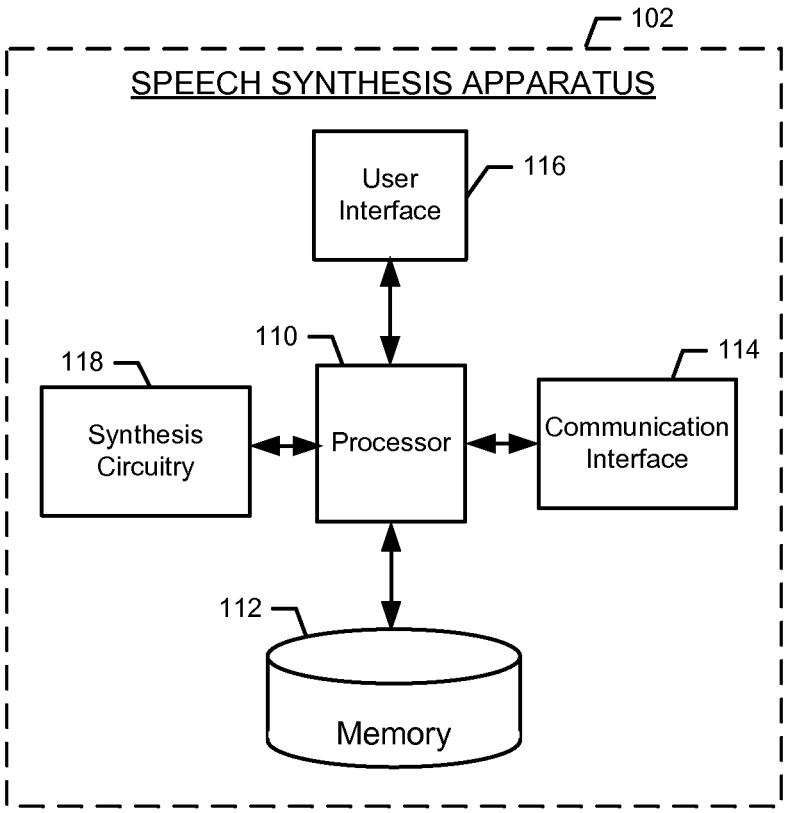
FIG. 1 illustrates a block diagram of a speech synthesis apparatus for facilitating speech synthesis according to an example embodiment.

Some embodiments of the present invention will now be described more fully hereinafter with reference to the accompanying drawings, in which some, but not all embodiments of the invention are shown. Indeed, the invention may be embodied in many different forms and should not be construed as limited to the embodiments set forth herein; rather, these embodiments are provided so that this disclosure will satisfy applicable legal requirements. Like reference numerals refer to like elements throughout.

As used herein, the term 'circuitry' refers to (a) hardware-only circuit implementations (e.g., implementations in analog circuitry and/or digital circuitry); (b) combinations of circuits and computer program product(s) comprising software and/or firmware instructions stored on one or more computer readable memories that work together to cause an apparatus to perform one or more functions described herein; and (c) circuits, such is for example, a microprocessor(s) or a portion of a microprocessor(s), that require software or firmware for operation even if the software or firmware is not physically present. This definition of 'circuitry' applies to all uses of this term herein, including in any claims. As a further example, as used herein, the term 'circuitry' also includes an implementation comprising one or more processors and/or portion(s) thereof and accompanying software and/or firmware. As another example, the term 'circuitry' as used herein also includes, for example, a baseband integrated circuit or applications processor integrated circuit for a mobile phone or a similar integrated circuit in a server, a cellular network device, other network device, and/or other computing device.

Current speech synthesizers are generally based on either unit selection or HMM (Hidden Markov Model) based speech synthesis. In the unit selection approach, synthesized speech is constructed by concatenating locally stored units of pre-recorded speech. Further speech processing techniques may be used to attempt to smooth possible discontinuities at concatenation boundaries. In the HMM-based approach, a speech database is used for training statistical models that are used during synthesis for generating speech parameters that are further converted to speech.

In spite of continued research and advancements in speech synthesis, the above approaches continue to exhibit weaknesses that may negatively impact synthesized speech quality, and thus user experience. Although unit selection may achieve excellent speech quality in favorable conditions, speech unit is limited to the available stored units and accordingly may fail to achieve even remotely acceptable speech quality if suitable units are not in the stored database. In this regard, in practice, it is exceedingly expensive and practically impossible to record and label a database containing perfectly matching speech units for any arbitrary input text, especially if the speech has to contain rich prosodic/intonational variations. While HMM based synthesis may solve some of the problems of unit selection, current HMM synthesizers suffer from averaging effects that may cause a lack of naturalness and the resulting speech may sound clearly artificial to human listeners. Further, some phonemes are typically hard to synthesize correctly using unit selection, while some are hard to create using HUM based synthesis.

Accordingly, at least some of the example embodiments provided herein may address the above problems by using a unique hybrid approach combining a statistical model approach, such as HMM-based synthesis, and a unit selection-based approach. FIG. 1 illustrates a block diagram of a speech synthesis apparatus 102 for facilitating speech synthesis according to an example embodiment. It will be appreciated that the speech synthesis apparatus 102 is provided as an example of one embodiment and should not be construed to narrow the scope or spirit of the disclosure in any way. In this regard, the scope of the disclosure encompasses many potential embodiments in addition to those illustrated and described herein. As such, while FIG. 1 illustrates one example of a configuration of a speech synthesis apparatus for facilitating speech synthesis, numerous other configurations may also be used to implement embodiments of the present invention.

The speech synthesis apparatus 102 may be embodied as a desktop computer, laptop computer, mobile terminal, mobile computer, mobile phone, mobile communication device, tablet computer, one or more servers, one or more network nodes, game device, digital camera/camcorder, audio/video player, television device, radio receiver, digital video recorder, positioning device, any combination thereof, and/or the like. In an example embodiment, the speech synthesis apparatus 102 is embodied as a mobile terminal, such as that illustrated in FIG. 2.

Figure 2:
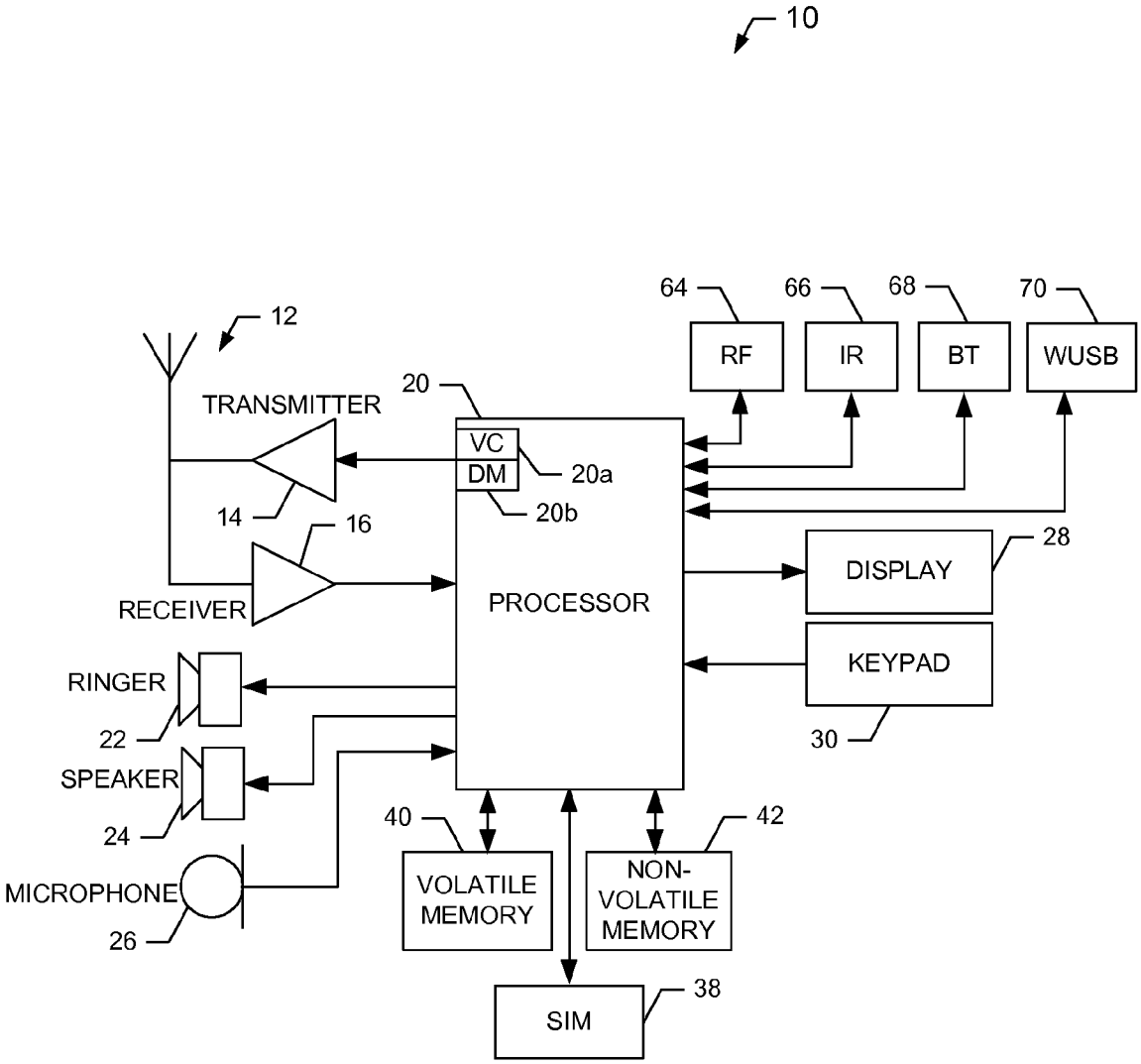
FIG. 2 is a schematic block diagram of a mobile terminal according to an example embodiment.

In this regard, FIG. 2 illustrates a block diagram of a mobile terminal 10 representative of one embodiment of a speech synthesis apparatus 102. It should be understood, however, that the mobile terminal 10 illustrated and hereinafter described is merely illustrative of one type of speech synthesis apparatus 102 that may implement and/or benefit from various embodiments and, therefore, should not be taken to limit the scope of the disclosure. While several embodiments of the electronic device are illustrated and will be hereinafter described for purposes of example, other types of electronic devices, such as mobile telephones, mobile computers, portable digital assistants (PDAs), pagers, laptop computers, desktop computers, gaming devices, televisions, and other types of electronic systems, may employ embodiments of the present invention.

As shown, the mobile terminal 10 may include an antenna 12 (or multiple antennas 12) in communication with a transmitter 14 and a receiver 16. The mobile terminal 10 may also include a processor 20 configured to provide signals to and receive signals from the transmitter and receiver, respectively. The processor 20 may, for example, be embodied as various means including circuitry, one or more microprocessors with accompanying digital signal processor(s), one or more processor(s) without an accompanying digital signal processor, one or more coprocessors, one or more multi-core processors, one or more controllers, processing circuitry, one or more computers, various other processing elements including integrated circuits such as, for example, an ASIC (application specific integrated circuit) or FPGA (field programmable gate array), or some combination thereof. Accordingly, although illustrated in FIG. 2 as a single processor, in some embodiments the processor 20 comprises a plurality of processors. These signals sent and received by the processor 20 may include signaling information in accordance with an air interface standard of an applicable cellular system, and/or any number of different wireline or wireless networking techniques, comprising but not limited to Wireless-Fidelity (Wi-Fi), wireless local access network (WLAN) techniques such as Institute of Electrical and Electronics Engineers (IEEE) 802.11, 802.16, and/or the like. In addition, these signals may include speech data, user generated data, user requested data, and/or the like. In this regard, the mobile terminal may be capable of operating with one or more air interface standards, communication protocols, modulation types, access types, and/or the like. More particularly, the mobile terminal may be capable of operating in accordance with various first generation (1G), second generation (2G), 2.5G, third-generation (3G) communication protocols, fourth-generation (4G) communication protocols, Internet Protocol Multimedia Subsystem (IMS) communication protocols (e.g., session initiation protocol (SIP)), and/or the like. For example, the mobile terminal may be capable of operating in accordance with 2G wireless communication protocols IS-136 (Time Division Multiple Access (TDMA)), Global System for Mobile communications (GSM), IS-95 (Code Division Multiple Access (CDMA)), and/or the like. Also, for example, the mobile terminal may be capable of operating in accordance with 2.5G wireless communication protocols General Packet Radio Service (GPRS), Enhanced Data GSM Environment (EDGE), and/or the like. Further, for example, the mobile terminal may be capable of operating in accordance with 3G wireless communication protocols such as Universal Mobile Telecommunications System (UMTS), Code Division Multiple Access 2000 (CDMA2000), Wideband Code Division Multiple Access (WCDMA), Time Division-Synchronous Code Division Multiple Access (TD-SCDMA), and/or the like. The mobile terminal may be additionally capable of operating in accordance with 3.9G wireless communication protocols such as Long Term Evolution (LTE) or Evolved Universal Terrestrial Radio Access Network (E-UTRAN) and/or the like. Additionally, for example, the mobile terminal may be capable of operating in accordance with fourth-generation (4G) wireless communication protocols and/or the like as well as similar wireless communication protocols that may be developed in the future.

Some Narrow-band Advanced Mobile Phone System (NAMPS), as well as Total Access Communication System (TACS), mobile terminals may also benefit from embodiments of this invention, as should dual or higher mode phones (e.g., digital/analog or TDMA/CDMA/analog phones). Additionally, the mobile terminal 10 may be capable of operating according to Wireless Fidelity (Wi-Fi) or Worldwide Interoperability for Microwave Access (WiMAX) protocols.

It is understood that the processor 20 may comprise circuitry for implementing audio/video and logic functions of the mobile terminal 10. For example, the processor 20 may comprise a digital signal processor device, a microprocessor device, an analog-to-digital converter, a digital-to-analog converter, and/or the like. Control and signal processing functions of the mobile terminal may be allocated between these devices according to their respective capabilities. The processor may additionally comprise an internal voice coder (VC) 20*a*, an internal data modem (DM) 20*b*, and/or the like. Further, the processor may comprise functionality to operate one or more software programs, which may be stored in memory. For example, the processor 20 may be capable of operating a connectivity program, such as a web browser. The connectivity program may allow the mobile terminal 10 to transmit and receive web content, such as location-based content, according to a protocol, such as Wireless Application Protocol (WAP), hypertext transfer protocol (HTTP), and/or the like. The mobile terminal 10 may be capable of using a Transmission Control Protocol/Internet Protocol (TCP/IP) to transmit and receive web content across the internet or other networks.

The mobile terminal 10 may also comprise a user interface including, for example, an earphone or speaker 24, a ringer 22, a microphone 26, a display 28, a user input interface, and/or the like, which may be operationally coupled to the processor 20. In this regard, the processor 20 may comprise user interface circuitry configured to control at least some functions of one or more elements of the user interface, such as, for example, the speaker 24, the ringer 22, the microphone 26, the display 28, and/or the like. The processor 20 and/or user interface circuitry comprising the processor 20 may be configured to control one or more functions of one or more elements of the user interface through computer program instructions (e.g., software and/or firmware) stored on a memory accessible to the processor 20 (e.g., volatile memory 40, non-volatile memory 42, and/or the like). Although not shown, the mobile terminal may comprise a battery for powering various circuits related to the mobile terminal, for example, a circuit to provide mechanical vibration as a detectable output. The user input interface may comprise devices allowing the mobile terminal to receive data, such as a keypad 30, a touch display (not shown), a joystick (not shown), and/or other input device. In embodiments including a keypad, the keypad may comprise numeric (0-9) and related keys (#, *), and/or other keys for operating the mobile terminal.

As shown in FIG. 2, the mobile terminal 10 may also include one or more means for sharing and/or obtaining data. For example, the mobile terminal may comprise a short-range radio frequency (RF) transceiver and/or interrogator 64 so data may be shared with and/or obtained from electronic devices in accordance with RF techniques. The mobile terminal may comprise other short-range transceivers, such as, for example, an infrared (IR) transceiver 66, a Bluetooth™ (BT) transceiver 68 operating using Bluetooth™ brand wireless technology developed by the Bluetooth™ Special Interest Group, a wireless universal serial bus (USB) transceiver 70 and/or the like. The Bluetooth™ transceiver 68 may be capable of operating according to ultra-low power Bluetooth™ technology (e.g., Wibree™) radio standards. In this regard, the mobile terminal 10 and, in particular, the short-range transceiver may be capable of transmitting data to and/or receiving data from electronic devices within a proximity of the mobile terminal, such as within 10 meters, for example. Although not shown, the mobile terminal may be capable of transmitting and/or receiving data from electronic devices according to various wireless networking techniques, including Wireless Fidelity (Wi-Fi), WLAN techniques such as IEEE 802.11 techniques, IEEE 802.15 techniques, IEEE 802.16 techniques, and/or the like.

The mobile terminal 10 may comprise memory, such as a subscriber identity module (SIM) 38, a removable user identity module (R-UIM), and/or the like, which may store information elements related to a mobile subscriber. In addition to the SIM, the mobile terminal may comprise other removable and/or fixed memory. The mobile terminal 10 may include volatile memory 40 and/or non-volatile memory 42. For example, volatile memory 40 may include Random Access Memory (RAM) including dynamic and/or static RAM, on-chip or off-chip cache memory, and/or the like. Non-volatile memory 42, which may be embedded and/or removable, may include, for example, read-only memory, flash memory, magnetic storage devices (e.g., hard disks, floppy disk drives, magnetic tape, etc.), optical disc drives and/or media, non-volatile random access memory (NVRAM), and/or the like. Like volatile memory 40 non-volatile memory 42 may include a cache area for temporary storage of data. The memories may store one or more software programs, instructions, pieces of information, data, and/or the like which may be used by the mobile terminal for performing functions of the mobile terminal. For example, the memories may comprise an identifier, such as an international mobile equipment identification (IMEI) code, capable of uniquely identifying the mobile terminal 10.

Returning to FIG. 1, in an example embodiment, the speech synthesis apparatus 102 includes various means, such as a processor 110, memory 112, communication interface 114, user interface 116, and/or synthesis circuitry 118 for performing the various functions herein described. These means of the speech synthesis apparatus 102 as described herein may be embodied as, for example, circuitry, hardware elements (e.g., a suitably programmed processor, combinational logic circuit, and/or the like), a computer program product comprising computer-readable program instructions (e.g., software or firmware) stored on a computer-readable medium (e.g. memory 112) that is executable by a suitably configured processing device (e.g., the processor 110), or some combination thereof.

The processor 110 may, for example, be embodied as various means including one or more microprocessors with accompanying digital signal processor(s), one or more processor(s) without an accompanying digital signal processor, one or more coprocessors, one or more multi-core processors, one or more controllers, processing circuitry, one or more computers, various other processing elements including integrated circuits such as, for example, an ASIC (application specific integrated circuit) or FPGA (field programmable gate array), or some combination thereof. Accordingly, although illustrated in FIG. 1 as a single processor, in some embodiments the processor 110 comprises a plurality of processors. The plurality of processors may be in operative communication with each other and may be collectively configured to perform one or more functionalities of the speech synthesis apparatus 102 as described herein. The plurality of processors may be embodied on a single computing device or distributed across a plurality of computing devices collectively configured to function as the speech synthesis apparatus 102. In embodiments wherein the speech synthesis apparatus 102 is embodied as a mobile terminal 10, the processor 110 may be embodied as or comprise the processor 20. In an example embodiment, the processor 110 is configured to execute instructions stored in the memory 112 or otherwise accessible to the processor 110. These instructions, when executed by the processor 110, may cause the speech synthesis apparatus 102 to perform one or more of the functionalities of the speech synthesis apparatus 102 as described herein. As such, whether configured by hardware or software methods, or by a combination thereof, the processor 110 may comprise an entity capable of performing operations according to embodiments of the present invention while configured accordingly. Thus, for example, when the processor 110 is embodied as an ASIC, FPGA or the like, the processor 110 may comprise specifically configured hardware for conducting one or more operations described herein. Alternatively, as another example, when the processor 110 is embodied as an executor of instructions, such as may be stored in the memory 112, the instructions may specifically configure the processor 110 to perform one or more algorithms and operations described herein.

The memory 112 may comprise, for example, volatile memory, non-volatile memory, or some combination thereof. Although illustrated in FIG. 1 as a single memory, the memory 112 may comprise a plurality of memories. The plurality of memories may be embodied on a single computing device or may be distributed across a plurality of computing devices collectively configured to function as the speech synthesis apparatus 102. In various example embodiments, the memory 112 may comprise, for example, a hard disk, random access memory, cache memory, flash memory, a compact disc read only memory (CD-ROM), digital versatile disc read only memory (DVD-ROM), an optical disc, circuitry configured to store information, or some combination thereof. In embodiments wherein the speech synthesis apparatus 102 is embodied as a mobile terminal 10, the memory 112 may comprise the volatile memory 40 and/or the non-volatile memory 42. The memory 112 may be configured to store information, data, applications, instructions, or the like for enabling the speech synthesis apparatus 102 to carry out various functions in accordance with one or more example embodiments. For example, in at least some embodiments, the memory 112 is configured to buffer input data for processing by the processor 110. Additionally or alternatively, in at least some embodiments, the memory 112 is configured to store program instructions for execution by the processor 110. The memory 112 may store information in the form of static and/or dynamic information. The stored information may include, for example, speech units, a parametric representation of speech units, training data used to train a statistical model, one or more statistical models for speech synthesis, and/or the like. This stored information may be stored and/or used by the synthesis circuitry 118 during the course of performing its functionalities.

The communication interface 114 may be embodied as any device or means embodied in circuitry, hardware, a computer program product comprising computer readable program instructions stored on a computer readable medium (e.g., the memory 112) and executed by a processing device (e.g., the processor 110), or a combination thereof that is configured to receive and/or transmit data from/to an entity. For example, the communication interface 114 may be configured to communicate with a server, network node, user terminal, and/or the like over a network for purposes of disseminating synthesized speech generated on the speech synthesis apparatus 102. As a further example, the communication interface 114 may be configured to communicate with a server, network node, user terminal, and/or the like over a network to allow receipt of input data (e.g., text for conversion to speech, input speech for voice conversion, and/or the like) for synthesis into speech by the speech synthesis apparatus 102. As another example, in embodiments wherein the speech synthesis apparatus 102 comprises a server, network node, or the like, the communication interface 114 may be configured to communicate with a remote user terminal (e.g., the user terminal 304) to allow a user of the remote user terminal to access functionality provided by the speech synthesis apparatus 102. In an example embodiment, the communication interface 114 is at least partially embodied as or otherwise controlled by the processor 110. In this regard, the communication interface 114 may be in communication with the processor 110, such as via a bus. The communication interface 114 may include, for example, an antenna, a transmitter, a receiver, a transceiver and/or supporting hardware or software for enabling communications with one or more remote computing devices. The communication interface 114 may be configured to receive and/or transmit data using any protocol that may be used for communications between computing devices. In this regard, the communication interface 114 may be configured to receive and/or transmit data using any protocol that may be used for transmission of data over a wireless network, wireline network, some combination thereof, or the like by which the speech synthesis apparatus 102 and one or more computing devices are in communication. The communication interface 114 may additionally be in communication with the memory 112, user interface 116, and/or synthesis circuitry 118, such as via a bus.

The user interface 116 may be in communication with the processor 110 to receive an indication of a user input and/or to provide an audible, visual, mechanical, or other output to a user. As such, the user interface 116 may include, for example, a keyboard, a mouse, a joystick, a display, a touch screen display, a microphone, a speaker, and/or other input/output mechanisms. In embodiments wherein the speech synthesis apparatus 102 is embodied as one or more servers, aspects of the user interface 116 may be reduced or the user interface 116 may even be eliminated. The user interface 116 may be in communication with the memory 112, communication interface 114, and/or synthesis circuitry 118, such as via a bus. In this regard, the user interface 116 may provide means for a user to enter input for speech synthesis. For example, a user may enter text via a keyboard, keypad, touch screen display, and/or the like for conversion into speech. As another example, a user may input speech into a microphone for speech conversion. The user interface 116 (e.g., a speaker of the user interface) may additionally provide means for audibilization of synthesized speech to a user.

The synthesis circuitry 118 may be embodied as various means, such as circuitry, hardware, a computer program product comprising computer readable program instructions stored on a computer readable medium (e.g., the memory 112) and executed by a processing device (e.g., the processor 110), or some combination thereof and, in one embodiment, is embodied as or otherwise controlled by the processor 110. In embodiments wherein the synthesis circuitry 118 is embodied separately from the processor 110, the synthesis circuitry 118 may be in communication with the processor 110. The synthesis circuitry 118 may further be in communication with one or more of the memory 112, communication interface 114, or user interface 116, such as via a bus.

Figure 3:
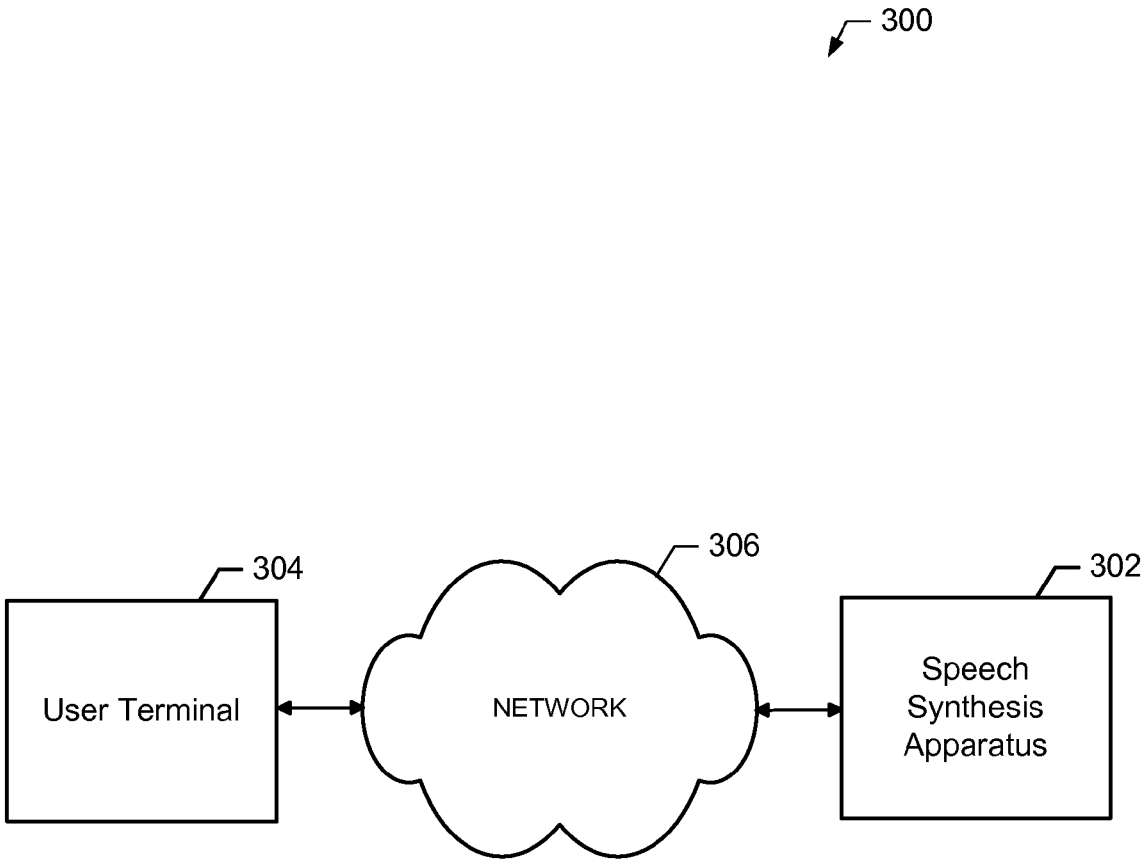
FIG. 3 illustrates a system for facilitating speech synthesis according to an example embodiment.

FIG. 3 illustrates a system 300 for facilitating speech synthesis according to an example embodiment. The system 300 comprises a speech synthesis apparatus 302 and a user terminal 304 configured to communicate over the network 306. The speech synthesis apparatus 302 may, for example, comprise an embodiment of the speech synthesis apparatus 102 wherein the speech synthesis apparatus 102 is embodied as one or more servers, one or more network nodes, or the like that is configured to provide speech synthesis services to a user of a remote user terminal. The user terminal 304 may comprise any computing device configured to access the network 306 and communicate with the speech synthesis apparatus 302 in order to access speech synthesis services provided by the speech synthesis apparatus 302. The user terminal 304 may, for example, be embodied as a desktop computer, laptop computer, mobile terminal, mobile computer, mobile phone, mobile communication device, mobile terminal 10, game device, digital camera/camcorder, audio/video player, television device, radio receiver, digital video recorder, positioning device, any combination thereof, and/or the like. The network 306 may comprise a wireline network, wireless network (e.g., a cellular network, wireless local area network, wireless wide area network, some combination thereof, or the like), or a combination thereof, and in one embodiment comprises the internet.

In the example system illustrated in FIG. 3, at least some aspects of the user interface 116 may be embodied on the user terminal 304. For example, the speech synthesis apparatus 302 may be configured to provide a network service, such as a web service, for providing speech synthesis services to one or more user terminals 304. In this regard, the speech synthesis apparatus 302 (e.g., communication interface 114) may be configured to receive input (e.g., text or speech) from the user terminal 304 for synthesis into speech and provide the synthesized speech to the user terminal 304 or another apparatus.

In another example embodiment of the system 300, aspects of the synthesis circuitry 118 may be distributed between the user terminal 304 and speech synthesis apparatus 302. In this example embodiment, the speech synthesis apparatus 302 may handle certain processing tasks required for generating a speech synthesis while other aspects of speech synthesis are handled by the user terminal 304. Additionally or alternatively, the memory 112 may be distributed between the speech synthesis apparatus 302 and user terminal 304 such that the speech synthesis apparatus 302 may store and provide access to at least a portion of a database of speech units for use in speech synthesis to the user terminal 304. In this regard, the user terminal 304 may not be required to perform some of the more processor-intensive speech synthesis operations and/or may not be required to store the entirety of a database of speech units used to facilitate speech synthesis.

The synthesis circuitry 118 is configured in some example embodiments to access a source input to be synthesized into speech. The source input may, for example, comprise text to be converted into speech via a TTS conversion. As another example, the source input may comprise speech in a first voice to be converted into a target voice via a voice conversion. The source input may be locally stored, such as in memory 112. In this regard, the source input may, for example, comprise displayed text to be converted into speech for playback to a user. As another example, the source input may, for example, be accessed from a user input to the user interface 116. As a further example, the source input may be accessed from data received from a remote apparatus, such as a user terminal 304 via the communication interface 114.

In order to synthesize the source input to speech (e.g., via a TTS conversion, voice conversion, or the like), the synthesis circuitry 118 may be configured to utilize a statistical modeling synthesizer in combination with unit selection. In this regard, the synthesis circuitry 118 may be configured to access a plurality stored pre-recorded speech units. These speech units may be stored in the memory 112 or in another memory accessible to the synthesis circuitry 118, such as, for example, in a remote database accessible over a network. The speech units may have a parametric representation, which may facilitate efficient storage of the speech units and allow for flexible speech processing. The parameter representation of a given speech unit may, for example, be defined by values specifying one or more of pitch, energy, voicing, approximation of the vocal tract contribution, residual amplitudes, or the like. The approximation of the vocal tract contribution may, for example, be represented as a line spectral frequency (LSF). Given the parametric representations of speech units in some example embodiments, the synthesis circuitry 118 may, for example, be configured to implement unit selection using a very low bit rate (VLBR) codec. The parameters defining a parametric representation may be relatively independent, which may allow for modification of parameter tracks separately with very little degradation of speech quality during the speech synthesis according to one or more of the example embodiments described herein. This may, for example, facilitate performing smoothing at concatenation boundaries between speech units. Further, parametric representation may facilitate high-quality duration modifications.

The statistical model synthesizer used by the synthesis circuitry 118 may comprise any one or more statistical models appropriate for speech synthesis. In some example embodiments, the statistical model synthesizer comprises a Hidden Markov Model (HMM) synthesizer. It will be appreciated that other statistical model synthesizers, such as a Gaussian Mixture Model (GMM), may be used by the synthesis circuitry 118 in addition to or in lieu of an HMM synthesizer. The statistical model synthesizer may be trained using one or more speech databases. In some example embodiments, the statistical model synthesizer is trained using the parametric representations of the we-recorded speech units used for unit selection. In such example embodiments, training of the statistical model synthesizer may be complemented with additional speech parameters, such as, a more refined representation of the speech/residual spectrum.

The synthesis circuitry 118 may be configured to use the statistical model synthesizer for statistical modeling of a source input to be synthesized. In this regard, the synthesis circuitry may use the statistical model synthesizer to generate a plurality of input models representing the input. The synthesis circuitry 118 is configured in some example embodiments to use the input models to guide unit selection. In this regard, the synthesis circuitry 118 may be configured to determine a speech unit sequence representing at least a portion of the input by using the input models to influence selection of one or more of the pre-recorded speech units. The synthesis circuitry 118 may, for example, be configured to determine the speech unit sequence by computing a target cost between unit selection frames and the input models.

The synthesis circuitry 118 may be additionally configured to identify one or more bad units in the determined speech unit sequence. A bad unit may, for example, comprise an unnatural prosody, or may otherwise be inappropriate within the speech unit sequence. As another example, a bad unit may comprise a noise unit, noise frame, corrupted unit, corrupted frame, or the like. In this regard, some phonemes are inherently highly context dependent and hard to label. A bad unit may, for example, be introduced into the speech unit sequence due to a lack of an appropriate speech unit representation for a portion of the source input. In this regard, some units (e.g., phonemes) are relatively rare and a database of pre-recorded speech units available to the synthesis circuitry 118 may not contain many (or any) instances of some rare units, such as rare phonemes. Depending on the available units and the selected unit size (phoneme, diphone, half-phoneme, etc), the concatenation may also be challenging. Due to these reasons, there may not be good units available at all, or one or more units selected for the speech unit sequence might be contextually or prosodically inappropriate to represent the input. The synthesis circuitry 118 may be configured to identify bad units through heuristics, such as by measuring the suitability of a given unit in the unit sequence by various criteria (e.g., through target cost) and/or by measuring the concatenation discontinuity of concatenated units (e.g., join cost or concatenation cost). In this regard, a bad unit may have a cost exceeding one or more of a threshold target cost or a threshold concatenation cost.

In some example embodiments, the synthesis circuitry 118 is configured to determine the speech unit sequence and identify bad units in the sequence simultaneously through the use of a robust Viterbi algorithm.

Use of the robust Viterbi algorithm may allow the synthesis circuitry to ignore the outlier units for which no good candidates are found in the database of speech units. In this regard, unlike a standard Viterbi algorithm, the robust Viterbi algorithm may skip some speech units during a search, thus preventing single unsuitable candidates from drifting the search. In this regard, when a robust Viterbi algorithm is used, all possible subsequences with up to a pre-defined number of excluded units may be taken into account when performing unit selection. Accordingly, units with a high cost value are likely to be ignored and hence may not corrupt the rest of the search during unit selection. In this regard, use of the robust Viterbi algorithm for automatic recognition of noise-corrupted speech units may alleviate the effect of outliers and provide for simultaneous determination of a speech unit sequence and identification of any bad units within the speech unit sequence.

In embodiments wherein the synthesis circuitry 118 is configured to use the robust Viterbi algorithm, the synthesis circuitry 118 may be configured to determine whether a respective speech unit is included based at least in part on the respective costs resulting from excluding a unit and from retaining it. The cost of a unit candidate and the best sequence of preceding candidates with a total of k units excluded may be determined as the minimum of the cost of (1) retaining the candidate unit and (2) excluding k preceding units and the cost of excluding the candidate and k−1 units before. All possible numbers of excluded units up to a predefined maximum number may be considered.

The synthesis circuitry 118 is additionally configured in some example embodiments to replace identified bad units. The synthesis circuitry 118 may, for example, replace identified bad units within a unit sequence with one or more parameters generated by the statistical model synthesizer. In this regard, the synthesis circuitry 118 may be configured to concatenate a parameter generated by the statistical model synthesizer with parameters representing the unit sequence. Accordingly, the synthesis circuitry 118 may be configured to synthesize speech having a combination of parameters derived from unit selection synthesis and parameters derived from statistical model based synthesis.

In this regard, the flexible parameter representation of speech units in some example embodiments may allow the synthesis circuitry 118 to perform further speech processing at the boundaries and also inside units, as units selected via unit selection may be further modified based on the corresponding outcome of the statistical model synthesizer. Accordingly, it will be appreciated that some example embodiments of the invention provide for speech processing and parameter concatenation both within a single speech frame (covering, for example, 2-20 milliseconds of speech) and between adjacent speech frames. Combining parameters generated by the statistical model synthesizer with parameters representing selected speech units may further allow the synthesis circuitry 118 to perform prosodic modifications. In this regard, a prosody generated by the statistical model synthesizer may perceptually outperform a prosody of the synthetic speech produced using unit selection. Further, concatenation of parameters generated by the statistical model synthesizer with parameters representing selected units in the parameter domain may cause little or no audible distortion in the resulting speech and may often improve the perceived quality/naturalness. Further, the use of real speech units selected through unit selection to form at least a portion of the synthesized speech may make the synthesized speech sound less artificial than speech generated using pure HMM synthesis.

Figure 4:
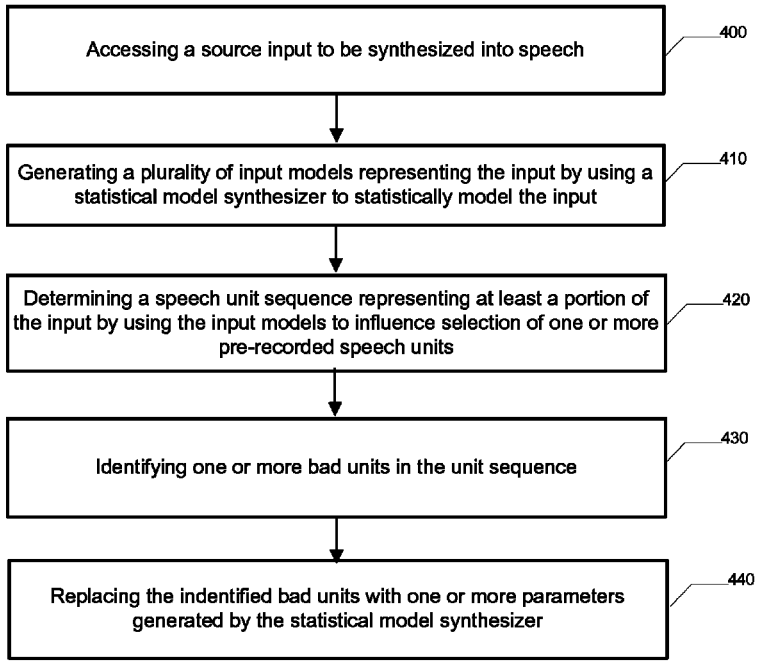
FIG. 4 illustrates a flowchart according to an example method for facilitating speech synthesis according to an example embodiment.

FIG. 4 illustrates a flowchart according to an example method for facilitating speech synthesis according to an example embodiment of the invention. The operations illustrated in and described with respect to FIG. 4 may, for example, be performed by, under the control of, and/or with the assistance of one or more of the processor 110, memory 112, communication interface 114, user interface 116, or the synthesis circuitry 118. Operation 400 may comprise accessing a source input to be synthesized into speech. Operation 410 may comprise generating a plurality of input models representing the input by using a statistical model synthesizer to statistically model the input. Operation 420 may comprise determining a speech unit sequence representing at least a portion of the input by using the input models to influence selection of one or more pre-recorded speech units. Operation 430 may comprise identifying one or more bad units in the unit sequence. Operation 440 may comprise replacing the indentified bad units with one or more parameters generated by the statistical model synthesizer.

FIG. 4 is a flowchart of a system, method, and computer program product according to example embodiments of the invention. It will be understood that each block of the flowchart, and combinations of blocks in the flowchart, may be implemented by various means, such as hardware and/or a computer program product comprising one or more computer-readable mediums having computer readable program instructions stored thereon. For example, one or more of the procedures described herein may be embodied by computer program instructions of a computer program product. In this regard, the computer program product(s) which embody the procedures described herein may be stored by one or more memory devices of a mobile terminal, server, or other computing device and executed by a processor in the computing device. In some embodiments, the computer program instructions comprising the computer program product(s) which embody the procedures described above may be stored by memory devices of a plurality of computing devices. As will be appreciated, any such computer program product may be loaded onto a computer or other programmable apparatus to produce a machine, such that the computer program product including the instructions which execute on the computer or other programmable apparatus creates means for implementing the functions specified in the flowchart block(s). Further, the computer program product may comprise one or more computer-readable memories on which the computer program instructions may be stored such that the one or more computer-readable memories can direct a computer or other programmable apparatus to function in a particular manner, such that the computer program product comprises an article of manufacture which implements the function specified in the flowchart block(s). The computer program instructions of one or more computer program products may also be loaded onto a computer or other programmable apparatus (e.g., a speech synthesis apparatus 102) to cause a series of operations to be performed on the computer or other programmable apparatus to produce a computer-implemented process such that the instructions which execute on the computer or other programmable apparatus implement the functions specified in the flowchart block(s).

Accordingly, blocks of the flowchart support combinations of means for performing the specified functions. It will also be understood that one or more blocks of the flowchart, and combinations of blocks in the flowchart, may be implemented by special purpose hardware-based computer systems which perform the specified functions, or combinations of special purpose hardware and computer program product(s).

The above described functions may be carried out in many ways. For example, any suitable means for carrying out each of the functions described above may be employed to carry out embodiments of the invention. In one embodiment, a suitably configured processor may provide all or a portion of the elements. In another embodiment, all or a portion of the elements may be configured by and operate under control of a computer program product. The computer program product for performing the methods of embodiments of the invention includes a computer-readable storage medium, such as the non-volatile storage medium, and computer-readable program code portions, such as a series of computer instructions, embodied in the computer-readable storage medium.

In one example embodiment, a method is provided, which comprises generating a plurality of input models representing an input by using a statistical model synthesizer to statistically model the input. The method of this embodiment further comprises determining a speech unit sequence representing at least a portion of the input by using the input models to influence selection of one or more pre-recorded speech units having parameter representations. The method of this embodiment may additionally comprise identifying one or more bad units in the unit sequence. The method of this embodiment may also comprise replacing the identified one or more bad units with one or more parameters generated by the statistical model synthesizer.

The input may comprise text to be converted into speech. The input may alternatively comprise speech in a first voice to be converted into a target voice. The statistical model synthesizer may comprise a Hidden Markov Model synthesizer. The statistical model synthesizer may be trained in part using the pre-recorded speech units having parameter representations.

The parameter representation of a speech unit may be defined by values specifying one or more of pitch, energy, voicing, approximation of the vocal tract contribution or residual amplitudes. The approximation of the vocal tract contribution may be represented as a line spectral frequency.

Determining the speech unit sequence may comprise computing a target cost between unit selection frames and the input models. Determining the speech unit sequence and identifying one or more bad units in the unit sequence may be performed simultaneously using a robust Viterbi algorithm. Identifying one or more bad units may comprise using heuristics to identify one or more bad units. Identifying one or more bad units may comprise identifying one or more units having costs exceeding one or more of a threshold target cost or a threshold concatenation cost.

Replacing the indentified one or more bad units with one or more parameters generated by the statistical model synthesizer may comprise concatenating the one or more parameters generated by the statistical model synthesizer with parameters representing the unit sequence.

In another example embodiment, an apparatus is provided. The apparatus of this embodiment comprises at least one processor and at least one memory storing computer program code, wherein the at least one memory and stored computer program code are configured, with the at least one processor, to cause the apparatus to at least generate a plurality of input models representing an input by using a statistical model synthesizer to statistically model the input. The at least one memory and stored computer program code are configured, with the at least one processor, to further cause the apparatus of this embodiment to determine a speech unit sequence representing at least a portion of the input by using the input models to influence selection of one or more pre-recorded speech units having parameter representations. The at least one memory and stored computer program code may be configured, with the at least one processor, to additionally cause the apparatus of this embodiment to identify one or more bad units in the unit sequence. The at least one memory and stored computer program code may be configured, with the at least one processor, to also cause the apparatus of this embodiment to replace the identified one or more bad units with one or more parameters generated by the statistical model synthesizer.

The input may comprise text to be converted into speech. The input may alternatively comprise speech in a first voice to be converted into a target voice. The statistical model synthesizer may comprise a Hidden Markov Model synthesizer. The statistical model synthesizer may be trained in part using the pre-recorded speech units having parameter representations.

The parameter representation of a speech unit may be defined by values specifying one or more of pitch, energy, voicing, approximation of the vocal tract contribution or residual amplitudes. The approximation of the vocal tract contribution may be represented as a line spectral frequency.

The at least one memory and stored computer program code may be configured, with the at least one processor, to cause the apparatus of this embodiment to determine the speech unit sequence by computing a target cost between unit selection frames and the input models. The at least one memory and stored computer program code may be configured, with the at least one processor, to cause the apparatus of this embodiment to determine the speech unit sequence and identify one or more bad units in the unit sequence simultaneously using a robust Viterbi algorithm. The at least one memory and stored computer program code may be configured, with the at least one processor, to cause the apparatus of this embodiment to use heuristics to identify one or more bad units. The at least one memory and stored computer program code may be configured, with the at least one processor, to cause the apparatus of this embodiment to identify one or more bad units by identifying one or more units having costs exceeding one or more of a threshold target cost or a threshold concatenation cost.

The at least one memory and stored computer program code may be configured, with the at least one processor, to cause the apparatus of this embodiment to replace the indentified one or more bad units with one or more parameters generated by the statistical model synthesizer by concatenating the one or more parameters generated by the statistical model synthesizer with parameters representing the unit sequence.

In another example embodiment, a computer program product is provided. The computer program product of this embodiment includes at least one computer-readable storage medium having computer-readable program instructions stored therein. The program instructions of this embodiment comprise program instructions configured to generate a plurality of input models representing an input by using a statistical model synthesizer to statistically model the input. The program instructions of this embodiment further comprise program instructions configured to determine a speech unit sequence representing at least a portion of the input by using the input models to influence selection of one or more pre-recorded speech units having parameter representations. The program instructions of this embodiment may additionally comprise program instructions configured to identify one or more bad units in the unit sequence. The program instructions of this embodiment may also comprise program instructions configured to replace the identified one or more bad units with one or more parameters generated by the statistical model synthesizer.

The input may comprise text to be converted into speech. The input may alternatively comprise speech in a first voice to be converted into a target voice. The statistical model synthesizer may comprise a Hidden Markov Model synthesizer. The statistical model synthesizer may be trained in part using the pre-recorded speech units having parameter representations.

The parameter representation of a speech unit may be defined by values specifying one or more of pitch, energy, voicing, approximation of the vocal tract contribution or residual amplitudes. The approximation of the vocal tract contribution may be represented as a line spectral frequency.

The program instructions configured to determine the speech unit sequence may comprise instructions configured to compute a target cost between unit selection frames and the input models. The program instructions configured to determine the speech unit sequence and the program instructions configured to identify one or more bad units in the unit sequence may comprise program instructions configured to determine the speech unit sequence and identify one or more bad units simultaneously using a robust Viterbi algorithm. The program instructions configured to identify one or more bad units may comprise program instructions configured to use heuristics to identify one or more bad units. The program instructions configured to identify one or more bad units may comprise program instructions configured to identify one or more units having costs exceeding one or more of a threshold target cost or a threshold concatenation cost.

The program instructions configured to replace the indentified one or more bad units with one or more parameters generated by the statistical model synthesizer may comprise instructions configured to concatenate the one or more parameters generated by the statistical model synthesizer with parameters representing the unit sequence.

As such, then, some embodiments of the invention provide several advantages to computing devices and computing device users. Some example embodiments synthesize speech using a combination of statistical model-based speech synthesis and unit selection-based speech synthesis. In this regard, some example embodiments use models generated using a statistical model to influence unit selection for determining a unit sequence. Some example embodiments determine bad units in the generated unit sequence. The detected bad units are replaced in some example embodiments with parameters generated by a statistical model synthesizer, such as a Hidden Markov Model synthesizer. In some example embodiments, the speech units used for unit selection have a parameter representation. In this regard, some example embodiments provide for speech synthesis through a combination of parameters specified by unit selection synthesis and parameters specified using statistical model-based synthesis.

Many modifications and other embodiments of the inventions set forth herein will come to mind to one skilled in the art to which these inventions pertain having the benefit of the teachings presented in the foregoing descriptions and the associated drawings. Therefore, it is to be understood that the embodiments of the invention are not to be limited to the specific embodiments disclosed and that modifications and other embodiments are intended to be included within the scope of the invention. Moreover, although the foregoing descriptions and the associated drawings describe example embodiments in the context of certain example combinations of elements and/or functions, it should be appreciated that different combinations of elements and/or functions may be provided by alternative embodiments without departing from the scope of the invention. In this regard, for example, different combinations of elements and/or functions than those explicitly described above are also contemplated within the scope of the invention. Although specific terms are employed herein, they are used in a generic and descriptive sense only and not for purposes of limitation.

What is claimed is:

1. A method comprising:

generating a plurality of input models representing an input by using a statistical model synthesizer to statistically model the input;

determining, using a processor, a speech unit sequence representing at least a portion of the input by using the input models to influence selection of one or more pre-recorded speech units having parameter representations;

identifying one or more bad units in the speech unit sequence, wherein determining the speech unit sequence and identifying one or more bad units in the speech unit sequence are performed substantially simultaneously; and replacing the identified one or more bad units with one or more parameters generated using the statistical model synthesizer.

2. The method of claim 1, wherein replacing the identified one or more bad units with one or more parameters generated by the statistical model synthesizer further comprises concatenating the one or more parameters generated by the statistical model synthesizer with parameters representing the speech unit sequence.

3. The method of claim 1, wherein identifying one or more bad units further comprises identifying one or more units having costs exceeding one or more of a threshold target cost or a threshold concatenation cost.

4. The method of claim 1, wherein the statistical model synthesizer is trained at least in part using the pre-recorded speech units having parameter representations.

5. The method of claim 1, wherein determining the speech unit sequence further comprises determining a target cost between unit selection frames and the input models.

6. The method of claim 1, wherein the input further comprises text to be converted into speech.

7. The method of claim 1, wherein the input further comprises speech in a first voice to be converted into a target voice.

8. An apparatus comprising at least one processor and at least one memory storing computer program code for one or more programs, wherein the at least one memory and stored computer program code are configured, with the at least one processor, to cause the apparatus to at least:

generate a plurality of input models representing an input by using a statistical model synthesizer to statistically model the input;

determine a speech unit sequence representing at least a portion of the input by using the input models to influence selection of one or more pre-recorded speech units having parameter representations identify one or more bad units in the speech unit sequence, wherein determining the speech unit sequence and identifying one or more bad units in the speech unit sequence are performed substantially simultaneously; and replace the identified one or more bad units with one or more parameters generated using the statistical model synthesizer.

9. The apparatus of claim 8, wherein the at least one memory and stored computer program code are configured, with the at least one processor, to further cause the apparatus to replace the identified one or more bad units with one or more parameters generated by the statistical model synthesizer at least in part by concatenating the one or more parameters generated by the statistical model synthesizer with parameters representing the speech unit sequence.

10. The apparatus of claim 8, wherein the at least one memory and stored computer program code are configured, with the at least one processor, to further cause the apparatus to identify one or more bad units at least in part by identifying one or more units having costs exceeding one or more of a threshold target cost or a threshold concatenation cost.

11. The apparatus of claim 8, wherein the statistical model synthesizer is trained at least in part using the pre-recorded speech units having parameter representations.

12. The apparatus of claim 8, wherein the at least one memory and stored computer program code are configured, with the at least one processor, to further cause the apparatus to determine the speech unit sequence at least in part by determining a target cost between unit selection frames and the input models.

13. The apparatus of claim 8, wherein the input further comprises one of text to be converted into speech or speech in a first voice to be converted into a target voice.

14. The apparatus of claim 8, wherein the apparatus comprises or is embodied on a mobile phone, the mobile phone further comprising:

user interface circuitry and user interface software stored on one or more of the at least one memory; wherein the user interface circuitry and user interface software are configured to:

facilitate user control of at least some functions of the mobile phone through use of a display; and cause at least a portion of a user interface of the mobile phone to be displayed on the display to facilitate user control of at least some functions of the mobile phone.

15. A computer program product comprising at least one non-transitory computer-readable storage medium having computer-readable program instructions for one or more programs stored therein, the computer-readable program instructions comprising program instructions configured to cause an apparatus to perform a method comprising:

generating a plurality of input models representing an input by using a statistical model synthesizer to statistically model the input;

determining a speech unit sequence representing at least a portion of the input by using the input models to influence selection of one or more pre-recorded speech units having parameter representations:

identifying one or more bad units in the speech unit sequence, wherein determining the speech unit sequence and identifying one or more bad units in the speech unit sequence are performed substantially simultaneously; and replacing the identified one or more bad units with one or more parameters generated using the statistical model synthesizer.

* * * * *